US009261813B2

(12) United States Patent
Tanaka

(10) Patent No.: US 9,261,813 B2
(45) Date of Patent: Feb. 16, 2016

(54) DEVELOPING APPARATUS HAVING ALIGNED REGULATING MEMBER

(71) Applicant: CANON KABUSHIKI KAISHA, Tokyo (JP)

(72) Inventor: Shigeru Tanaka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/551,255

(22) Filed: Nov. 24, 2014

(65) Prior Publication Data

US 2015/0153677 A1 Jun. 4, 2015

(30) Foreign Application Priority Data

Dec. 3, 2013 (JP) ..... 2013-250609

(51) Int. Cl.
*G03G 15/08* (2006.01)
*G03G 15/09* (2006.01)

(52) U.S. Cl.
CPC ..... *G03G 15/0812* (2013.01); *G03G 15/0893* (2013.01); *G03G 15/09* (2013.01); *G03G 2215/0822* (2013.01)

(58) Field of Classification Search
CPC ..... G03G 15/0812; G03G 15/0887; G03G 15/0889; G03G 15/0891; G03G 15/09; G03G 2215/0802; G03G 15/0813; G03G 15/0822; G03G 15/0827; G03G 15/0844
USPC ..... 399/256, 272, 274
See application file for complete search history.

(56) References Cited

U.S. PATENT DOCUMENTS

| | | | | |
|---|---|---|---|---|
| 7,263,315 | B2 | 8/2007 | Tanaka et al. | |
| 7,362,991 | B2 | 4/2008 | Tanaka | |
| 7,426,360 | B2 | 9/2008 | Arimoto et al. | |
| 7,483,655 | B2 * | 1/2009 | Tatsumi et al. | 399/256 X |
| 7,636,535 | B2 * | 12/2009 | Kunihiro et al. | 399/256 X |
| 7,856,196 | B2 * | 12/2010 | Sakamoto et al. | 399/256 X |
| 8,787,802 | B2 | 7/2014 | Hattori et al. | |

(Continued)

FOREIGN PATENT DOCUMENTS

| | | | |
|---|---|---|---|
| JP | 2000010336 | A | 1/2000 |
| JP | 2004077587 | A | 3/2004 |

(Continued)

OTHER PUBLICATIONS

Machine translation of JP 2007-147806 (published on Jun. 14, 2007) printed on Apr. 10, 2015.*

*Primary Examiner* — Sophia S Chen
(74) *Attorney, Agent, or Firm* — Fitzpatrick, Cella, Harper & Scinto

(57) ABSTRACT

A developing apparatus includes a developer carrying member, a regulating member configured to regulate developer carried on the developer carrying member, and a partition wall separating a first chamber and a second chamber. A first conveying screw conveys the developer in the first chamber, and a second conveying screw conveys the developer in the second chamber. The first conveying screw is at a position overlapping with a vertical line passing through a portion of the regulating member, and a periphery of the first conveying screw moves in the same direction as a peripheral surface of the developer carrying member that is faces. The vertical line overlaps with a part of a rotation region of the first conveying screw in which the periphery of the first conveying screw is moved in a downward direction.

8 Claims, 9 Drawing Sheets

(56) References Cited

U.S. PATENT DOCUMENTS

| | | | | |
|---|---|---|---|---|
| 2010/0034545 | A1* | 2/2010 | Imamura | 399/256 X |
| 2010/0226689 | A1* | 9/2010 | Mihara | 399/256 X |
| 2013/0230341 | A1* | 9/2013 | Tomishi et al. | 399/272 |
| 2013/0243495 | A1* | 9/2013 | Ishida | 399/274 |

FOREIGN PATENT DOCUMENTS

| | | | |
|---|---|---|---|
| JP | 2007147806 | A | 6/2007 |
| JP | 2012133212 | A | 7/2012 |

* cited by examiner

DEVELOPING APPARATUS HAVING ALIGNED REGULATING MEMBER

BACKGROUND OF THE INVENTION

1. Field of the Invention

The present invention relates to a developing apparatus to be used in an image forming apparatus such as a copying machine and a laser beam printer using an electrostatic recording process or an electrophotographic process, and configured to develop an electrostatic image formed on an image bearing member with developer including toner and carrier.

2. Description of the Related Art

Hitherto, in image forming apparatus such as a copying machine, an electrostatic latent image formed on a photosensitive drum serving as an image bearing member is developed into a visible image by a developing apparatus.

The developing apparatus is configured to supply toner to the photosensitive drum so as to visualize the latent image as a toner image. A developing apparatus using single-component developer containing magnetic toner as developer has been employed, and a developing apparatus using two-component developer which is a mixture of non-magnetic toner and magnetic carrier has also been employed in many cases. Development of the latent image with the two-component developer is excellent in stability of a toner charge amount, and hence color images can be formed with excellent color tone. For this reason, the two-component developer is suited to use in color-image forming apparatus.

In the developing apparatus, the developer reduced in density as a result of the development may be re-supplied to a developing sleeve without being sufficiently agitated. In this case, troubles such as image density unevenness may occur. Therefore, as a configuration for suppressing the image density unevenness, a developing process of a so-called separate function type has been employed as disclosed in Japanese Patent Application Laid-Open No. 2000-10336 and Japanese Patent Application Laid-Open No. 2012-133212. In the developing process of the separate function type, a developing chamber configured to supply developer to a developing sleeve and a collecting chamber (agitating chamber) configured to collect the developer from the developing sleeve after the development are separately formed so as to perform circulation agitation. With this, the rotation of the developer reduced in density together with the developing sleeve can be suppressed.

Further, the developing apparatus includes a regulating blade configured to regulate an amount of developer to be coated onto the developing sleeve serving as a developer carrying member of the developing apparatus. The developing sleeve is provided so as to face a part of a photosensitive member in a circumferential direction, and is generally arranged side by side with the photosensitive drum due to the restriction on the arrangement of other process units. Thus, the regulating blade is mostly arranged above or below the developing sleeve.

As described above, in the separate function type, when the regulating blade is positioned below the developing sleeve in the gravity direction, the following problem arises.

The developer to be regulated with the regulating blade and accumulated in a developing container is liable to be accumulated in the developing container after falling downward due to the gravity. The accumulated developer becomes immovable while being pressurized by developer conveyed successively to a position facing the regulating blade, resulting in an immobile layer. The developer accumulated into the immobile layer is rubbed by the developer that is being conveyed and moved, thereby raising a problem in that the life of the developer is shortened.

SUMMARY OF THE INVENTION

In view of the circumstances, the present invention provides a developing apparatus of a separate function type, which is configured to suppress degradation in developer which may be caused by accumulation of the developer at a blade facing portion in a case where a blade configured to regulate a layer thickness of a developer carrying member is provided below the developer carrying member.

In order to solve the above-mentioned problem, according to one embodiment of the present invention, there is provided a developing apparatus, comprising: a developer carrying member provided in a rotatable manner so as to face an image bearing member on which a latent image is formed, and configured to carry developer including toner and magnetic carrier so as to develop the latent image; a regulating member configured to regulate the developer carried on the developer carrying member, the regulating member having a distal end portion facing the developer carrying member and being positioned below a rotation center of the developer carrying member in a gravity direction; a first chamber formed so as to face a peripheral surface of the developer carrying member, and configured to supply the developer to the developer carrying member; a second chamber formed so as to face the peripheral surface of the developer carrying member at an upstream side with respect to the first chamber in a rotation direction of the developer carrying member, and configured to collect the developer from the developer carrying member, the second chamber communicating with the first chamber at both end portions of the second chamber so as to form a circulation route for circulating the developer between the first chamber and the second chamber; a first conveying member provided in a rotatable manner in the first chamber; and a second conveying member provided in a rotatable manner in the second chamber, the first conveying member being provided at a position overlapping with a vertical line passing through a position of the regulating member, the position of the regulating member being closest to the developer carrying member, a rotation direction of the first conveying member being defined so that a periphery of the first conveying member is moved in the same direction as the peripheral surface of the developer carrying member at a position at which the first conveying member faces the developer carrying member, the vertical line overlapping with a part of a rotation region of the first conveying member in which the periphery of the first conveying member is moved in a downward direction.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

(First Embodiment)

[Image Forming Apparatus]

Now, an image forming apparatus including a developing apparatus according a first embodiment of the present invention will be described.

Figure 1:
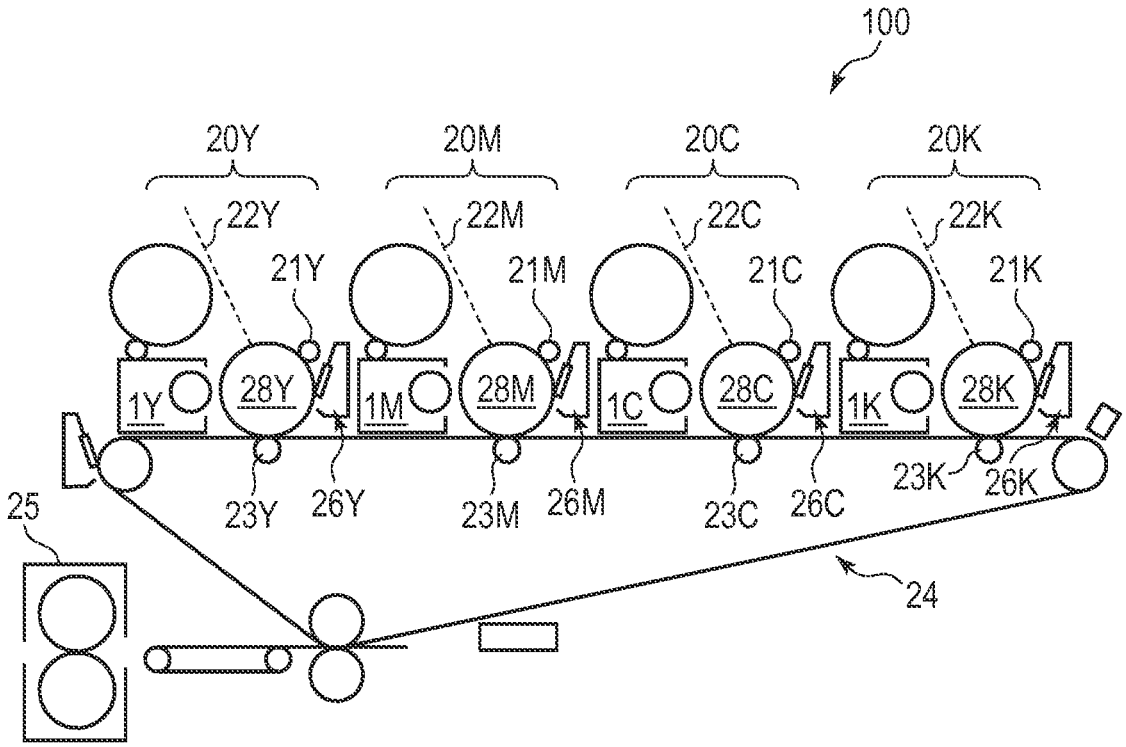
FIG. 1 is a view of an example of an image forming apparatus using a developing device according to the present invention.

As illustrated in FIG. 1, a developing apparatus 1 according to the embodiment is used in a full-color image forming apparatus 100 of a so-called tandem type. The image forming apparatus 100 includes, as image forming portions, a yellow station 20Y, a magenta station 20M, a cyan station 20C, and a black station 20K. Drum cartridges configured to perform toner image forming steps of those four colors, that is, yellow, magenta, cyan, and black, are provided in parallel to each other. Toner images of those four colors are superimposed on one another on an intermediate transfer belt 24, transferred collectively onto a transfer sheet, and then pressurized and heated by a fixing device 25. In this way, a full-color image is obtained. Note that, in the following description, components common to the drum cartridges of yellow, magenta, cyan, and black in FIG. 1 are denoted by reference numerals without suffixes "Y," "M," "C," and "K."

With reference to FIG. 1, toner image forming operation in each of the drum cartridges will be described. A surface of a photosensitive drum 28 charged by a primary charger 21 is exposed with a laser 22. With this, an electrostatic latent image is formed on the photosensitive drum 28, and the latent image is developed by the developing apparatus 1. In this way, toner images are obtained. The toner images are transferred in multiple layers onto the intermediate transfer belt 24 by primary transfer rollers 23. Untransferred residual toner remaining on the photosensitive drum 28 is removed by a cleaner 26.

[Developing Apparatus]

Figure 2:
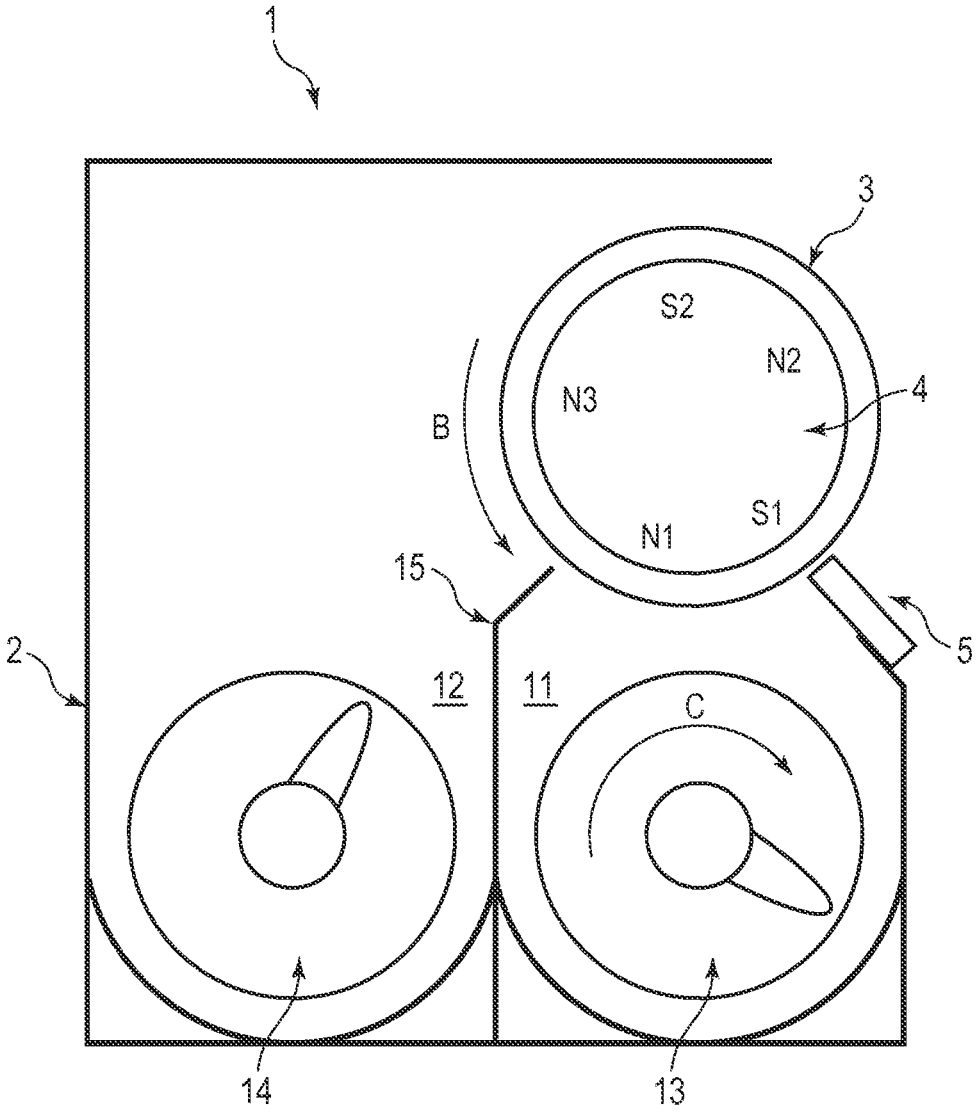
FIG. 2 is a sectional view of a developing device according to a first embodiment.

With reference to FIG. 2, the developing apparatus 1 (hereinafter referred to as developing device 1) according to the embodiment will be described in detail. The developing device 1 includes a developing container 2 configured to contain two-component developer, and a developing sleeve 3 provided as a developer carrying member at its opening portion. The developer will now be described. In the embodiment, a two-component developing process is employed as a developing process, and hence non-magnetic toner which is charged to have a negative polarity and magnetic carrier are mixed together and used as the developer. The non-magnetic toner refers to particles which are obtained by crashing or polymerizing resins such as a polyester resin and a styrene acrylic resin which contain colorants, wax components, and the like. The magnetic carrier is obtained by coating a resin onto each of surface layers of cores of resin particles kneaded with ferrite particles and magnetic powder. In the embodiment, toner density in the developer in an initial state (weight% of toner contained in the developer) is set to 8%.

In the developing container 2, a part facing the photosensitive drum 28 serving as an image bearing member is opened, and the developing sleeve 3 is arranged at the opening portion so as to be rotatable in a partially exposed manner. The developing sleeve 3 is made of a non-magnetic material, and includes a fixed built-in magnet 4 serving as a magnetic-field generating unit. The magnet 4 is fixed at an inside of the developing sleeve 3. The magnet 4 has a plurality of magnetic poles including a magnetic pole N1 and a magnetic pole N2 having the same polarity as that of the magnetic pole N1 and being arranged adjacently to the magnetic pole N1 at a downstream side in a rotation direction of the developing sleeve 3. A pair of repulsive magnetic poles (N1, N3) is formed in a circumferential direction of the developing sleeve 3. At a downstream side with respect to the magnetic pole N1, a magnetic pole S1 having a different polarity is arranged adjacently to the magnetic pole N1. The developing sleeve 3 rotates in a direction indicated by the arrow B of FIG. 2 so as to convey developer scooped at a position of the magnetic pole N1 of the magnetic-field generating unit toward a blade 5. The blade 5 serving as a regulating member is arranged below the developing sleeve 3 so as to face the developing sleeve 3, and a distal end portion of the blade 5 facing the developing sleeve 3 is arranged at a position below a rotation center of the developing sleeve 3 in a gravity direction. The developer, which is formed into a magnetic brush by the magnetic pole S1, is regulated in amount by receiving a shearing force from the blade 5. When passing through a gap between the developing sleeve 3 and the blade 5, the developer is formed into a developer layer having a predetermined layer thickness on the developing sleeve 3. The developer layer is carried and conveyed into a developing region in which the developing sleeve 3 faces the photosensitive drum 28. In a state in which the magnetic brush is formed, the electrostatic latent image formed on the surface of the photosensitive drum 28 is developed by the magnetic pole N2. After the development, the developer is released from the developing sleeve 3 at a non-magnetic region between the magnetic pole N3 and the magnetic pole N1.

The developing container 2 is partitioned by a partition wall 15 into a developing chamber 11 (first developer containing chamber) and an agitating chamber 12 (second developer containing chamber). The developing chamber 11 serving as a first chamber is formed so as to face a peripheral surface of the developing sleeve 3, and is configured to supply the developer to the developing sleeve 3. The agitating chamber 12 serving as a second chamber is formed so as to face the peripheral surface of the developing sleeve 3, and configured to collect the developer from the developing sleeve 3. Further, the agitating chamber 12 communicates with the developing chamber 11 at both end portions of the agitating chamber 12 so as to form a circulation route for circulating the developer between the developing chamber 11 and the agitating chamber 12.

The developing chamber 11 and the agitating chamber 12 extend along a rotation-axis direction of the developing sleeve 3. Both ends of the partition wall 15, which do not reach lateral walls of both end portions in a longitudinal direction in an inside of the developing container 2, form communication portions which allow the developer to pass through the communication portions between the developing chamber 11 and the agitating chamber 12. The developing chamber 11 and the agitating chamber 12 respectively include a first screw 13 and a second screw 14 serving as circulating-and-conveying members configured to circulate the developer between the developing chamber 11 and the agitating chamber 12. Rotation centers of the first screw 13 and the second screw 14 are formed below the rotation center of the developing sleeve 3 in the gravity direction. In the embodiment, the first screw 13 and the second screw 14 are provided at positions overlapping with each other as viewed in a horizontal direction. Further, in the embodiment, the first screw 13 and the second screw 14 are provided at such positions that, as viewed in the horizontal direction, the rotation center of at least one of the first screw 13 and the second screw 14 overlaps with a blade of another of the screws. In this way, the first screw 13 and the second screw 14 are arranged substantially horizontally with each other. In comparison with a case where the first screw 13 and the second screw 14 are arranged side by side in a vertical direction, influence that may be caused at the time of conveyance of the developer against the gravity can be reduced. As a result, conveyance property of the developer can be improved.

The developing sleeve 3, the first screw 13, and the second screw 14 are configured to be driven in conjunction with one another through respective gear trains (not shown), and also rotated by drive transmitted from a developing device drive gear (not shown). Through the rotation of the first screw 13 and the second screw 14, the developer is mixed and agitated while being circulated in the developing container 2. As the developing device 1 of the embodiment, a developing device of a so-called separate function type is employed. That is, the partition wall 15 is configured to come close to the developing sleeve 3 in the vicinity of the non-magnetic region of the developing sleeve 3 so that the developer on the developing sleeve 3 is contained in the agitating chamber 12 without being returned into the developing chamber 11 after the developer is released by the magnetic pole N3.

Further, in the embodiment, an exposure device (not shown) and a charger 21 are arranged above the photosensitive drum 28, whereas a primary transfer roller (transfer device) 23 is arranged below the photosensitive drum 28. With this, the developing device 1 is arranged side by side with the photosensitive drum 28. That is, the developing sleeve 3 is arranged so as to face the photosensitive drum 28 from the lateral direction thereof.

Figure 3:
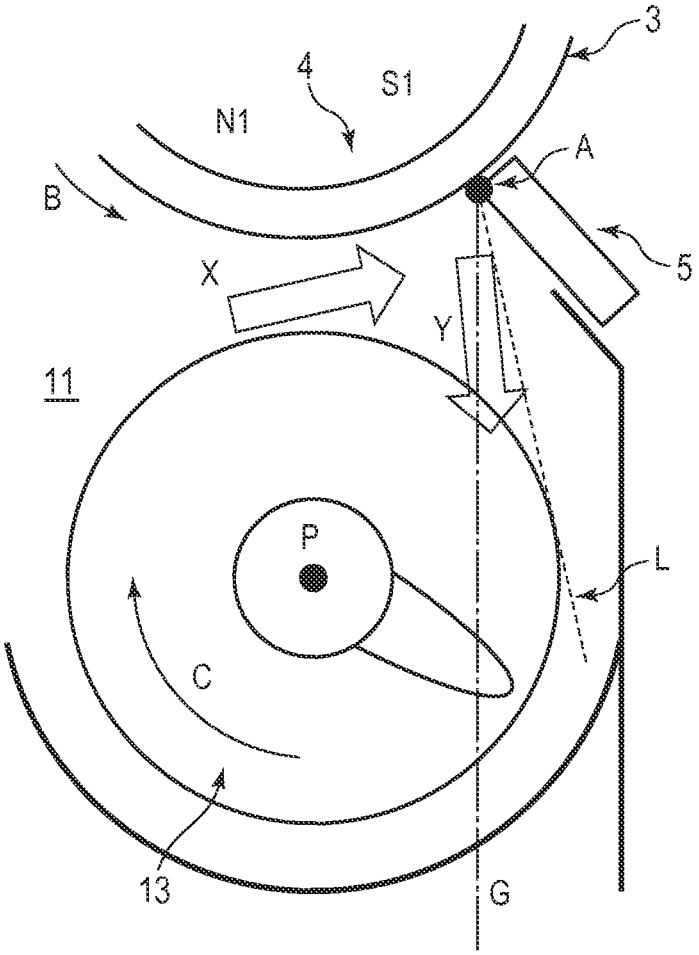
FIG. 3 is a sectional view illustrating features of the developing device in detail according to the first embodiment.

Next, features of the embodiment will be described with reference to FIG. 3.

In the embodiment, in the developing apparatus employing a separate function type, the flow of the developer around the blade 5 is optimized by optimizing the arrangement relationship between the blade 5 and the first screw 13 and the rotation direction of each of the developing sleeve 3 and the first screw 13. As a result, the accumulation of the developer around the blade 5 can be suppressed, and thus the degradation in developer can be suppressed. Now, the configuration will be described in detail.

First, the rotation direction of the first screw 13 and the flow of the developer along the rotation direction will be described. In the embodiment, the first screw 13 is configured to rotate in a direction indicted by the arrow C of FIG. 3. That is, the developing sleeve 3 and the first screw 13 rotate so that the movement directions of the developing sleeve 3 and the first screw 13 become the same at a facing portion between the developing sleeve 3 and the first screw 13. Therefore, a left half of the first screw 13 lifts the developer in the developing chamber 11 so as to throw up the developer toward the developing sleeve 3. The thrown developer is scooped onto the surface of the developing sleeve 3 with a magnetic force of the magnetic pole N1, and is moved in a direction indicated by the arrow X through the rotation of the developing sleeve 3 to be constrained by a magnetic force of the magnetic pole S1.

Herein, the developer receives a shearing force from the blade 5 in a state in which a magnetic brush is formed by the magnetic force of the magnetic pole S1 so that the developer is divided into a portion to be coated onto the surface of the developing sleeve 3 as a thin layer and a portion to be retained by the blade 5. The retained portion receives the gravity and a pushing force from the developer coming later similarly, to thereby move gradually in a direction indicated by the arrow Y of FIG. 3 against the magnetic force of the magnetic pole S1, with the result that the retained portion is conveyed to or falls to a region of a right half of the first screw 13. The reason why such a flow of the developer is realized is because a vertical line G extending downward from a closest point A between the blade 5 and the developing sleeve 3 is arranged between a tangent L drawn from the closest point A and a rotation-axis center point P of the first screw 13. In other words, the closest point A faces the descending rotation region of the first screw 13 in the vertical direction. Therefore, the developer having fallen after the regulation can move smoothly in the downward gravity direction through the rotation of the first screw 13.

In addition, the first screw 13 rotates in the direction indicated by the arrow C so that the flow of the developer conveyed above the first screw 13 and the flow of the developer conveyed from the magnetic pole N1 to the magnetic pole S1 of the developing sleeve 3 are moved in the same direction. Thus, those flows are not liable to disturb each other. In this way, the developer forms a smooth flow from the direction indicated by the arrow X (excluding a part coated with a thin layer) to the direction indicated by the arrow Y, and thus the developer is conveyed with less friction between the particles thereof. As described above, in the developing device of the present invention, the temperature increase of the retained developer is suppressed, and hence a fixed layer is not formed. Therefore, the life of the developer can be kept long.

Note that, in the embodiment, the magnetic pole N1 serving as a scooping magnetic pole is formed on an upstream side in the rotation direction of the developing sleeve 3 with respect to a closest point between the developing sleeve 3 and the first screw 13. Therefore, even when the rotation direction of the first screw 13 corresponds to the direction indicated by the arrow C of FIG. 3 as in the embodiment, scooping property of the developer to the developing sleeve 3 can be improved.

Note that, in the embodiment, an example in which the distal end portion of the blade 5 overlaps with the right half of the first screw 13 (region in which a blade of the first screw 13 moves downward) in the vertical direction has been described. However, the present invention is not limited thereto. As long as the distal end portion of the blade 5 overlaps with the first screw 13, the developer in the vicinity of the blade 5 can be captured without inhibiting the flow of the developer.

COMPARATIVE EXAMPLE

Figure 4:
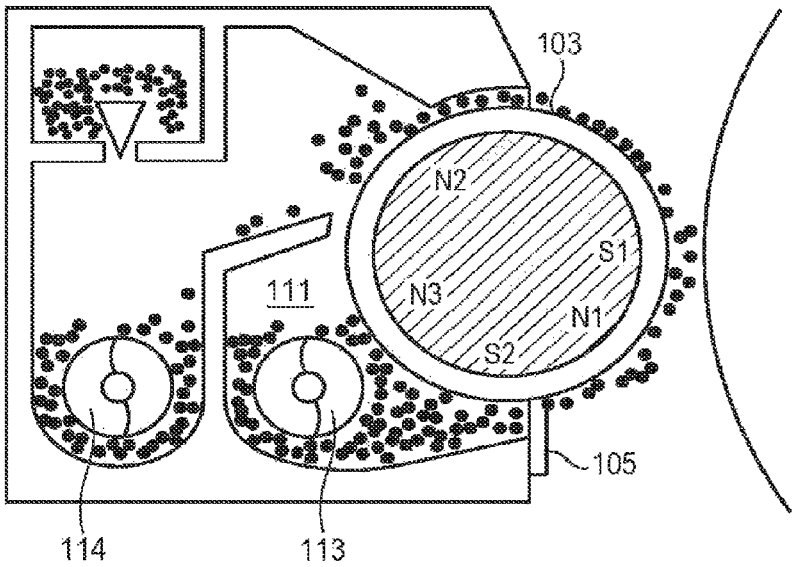
Prior Art FIG. 4
FIG. 4 is an explanatory sectional view of the conventional art.

Comparative Example 1 will be described with reference to FIG. 4. Comparative Example 1 describes a developing apparatus of a separate function type, but the position at which a first screw 113 is arranged is different from that of the first embodiment. Specifically, in Comparative Example 1, the first screw 113 is not arranged below the closest position between a blade 105 and a developing sleeve 103. Therefore, after the developer released from a magnetic pole S2 of FIG. 4 falls into a developing container, the developer is not agitated easily by the first screw 113 inside a developing chamber 111, and hence is liable to become an immobile layer.

Further, there is a risk in that the developer thus released and accumulated into the immobile layer may be formed into a fixed layer due to the temperature increase caused by the friction with the developer conveyed from the magnetic pole N3 to the magnetic pole S2. In this respect, in the first embodiment, the positional relationship between the first screw 13 and the blade 5 and the rotation direction thereof are set appropriately, and hence the life of the developer can be prolonged without forming the fixed layer.

Figure 5:
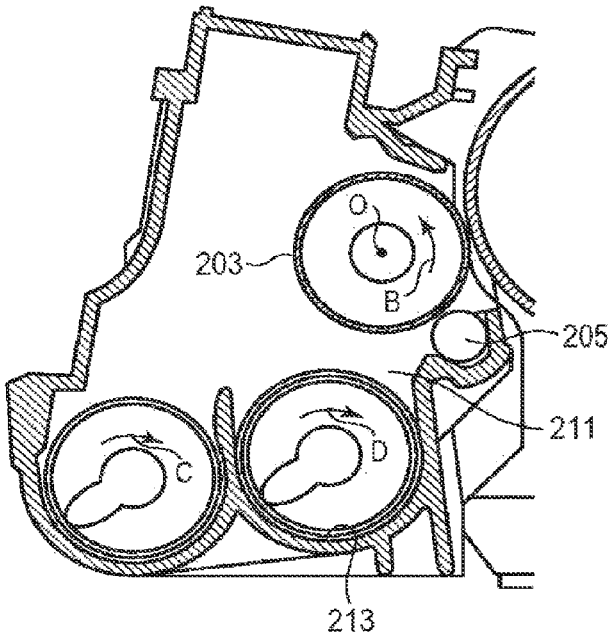
Prior Art FIG. 5
FIG. 5 is an explanatory sectional view of the conventional art.

Next, Comparative Example 2 will be described with reference to FIG. 5. The configuration of Comparative Example 2 is significantly different from that of the present invention because Comparative Example 2 does not employ the separate function type unlike the present invention. Note that, Comparative Example 2 is the same as the present invention in that a regulating member 205 is arranged below a developing sleeve 203. In Comparative Example 2, a first screw 213 rotates in a direction indicated by the arrow D of FIG. 5. However, Comparative Example 2 does not employ the separate function type, and hence the developer released from the developing sleeve 203 (which rotates in direction B about longitudinal axis 0) falls directly into a developing chamber 211. Therefore, in the case where the rotation direction of the first screw 213 corresponds to the direction indicated by the arrow D, immediately after the developer on the developing sleeve 203, which is reduced in density, is released, the developer is lifted by the first screw 213 onto the developing sleeve 203. Therefore, there is a risk in that the developer that has just been used for development may be immediately used for development again. This configuration may cause such troubles that the image density becomes smaller rapidly during high-density printing. Further, in Comparative Example 2, the first screw 213 and the closest position between the regulating member 205 and the developing sleeve 203 are not arranged at positions at which the first screw 213 and the closest position overlap with each other in the downward gravity direction. Therefore, the developer remaining in the developing container by being regulated with the regulating member 205 is accumulated on the upstream side with respect to the regulating member 205, resulting in an immobile layer.

Figure 6:
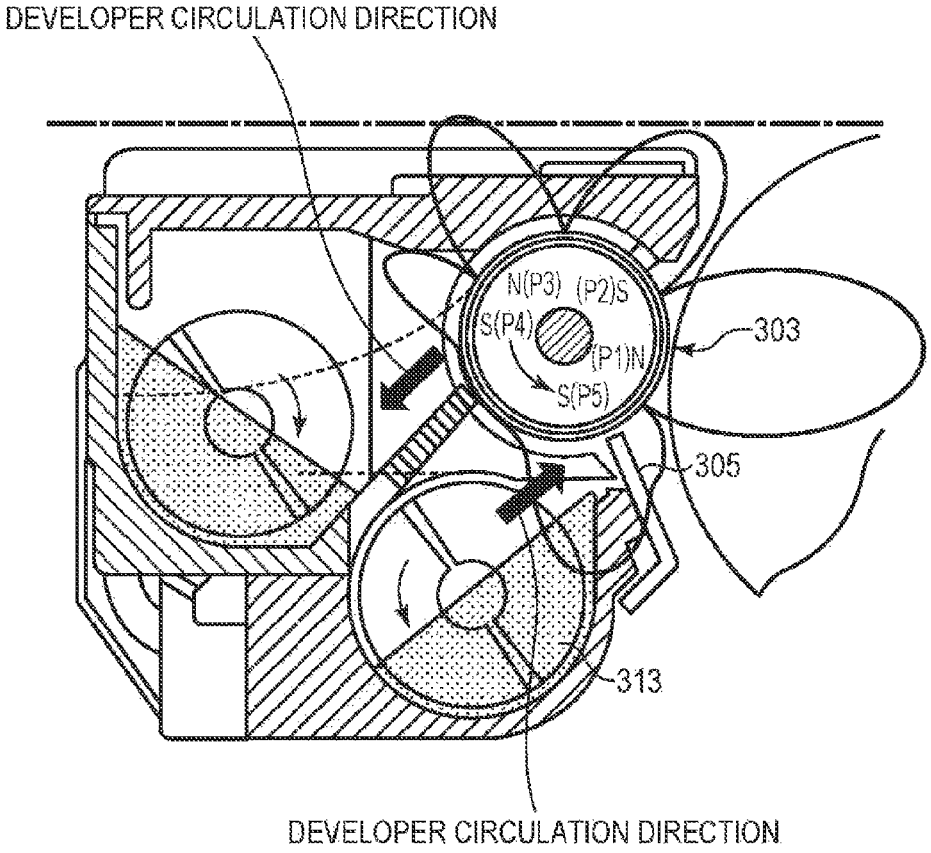
Prior Art FIG. 6
FIG. 6 is an explanatory sectional view of the conventional art.

Next, Comparative Example 3 will be described with reference to FIG. 6. Comparative Example 3 is the same as the first embodiment in that a developing apparatus of a separate function type is employed, and that a regulating blade 305 is provided below a developing sleeve 303. However, Comparative Example 3 is significantly different from the first embodiment in the rotation direction of a first screw 313. Therefore, the flow of the developer conveyed along with the rotation of the developing sleeve 303 (having magnetic poles P1-P5) and the flow of the developer conveyed along with the rotation of the first screw 313 are moved in reverse directions. Thus, the developer is liable to be degraded. Further, in Comparative Example 3, the first screw 313 and the closest position between the regulating blade 305 and the developing sleeve 303 are not arranged at positions at which the first screw 313 and the closest position overlap with each other in the downward gravity direction. Therefore, the developer remaining in the developing container by being regulated with the regulating blade 305 is accumulated on the upstream side with respect to the regulating blade 305, resulting in an immobile layer.

(Second Embodiment)

Now, a developing device according to a second embodiment of the present invention will be described.

Figure 7:
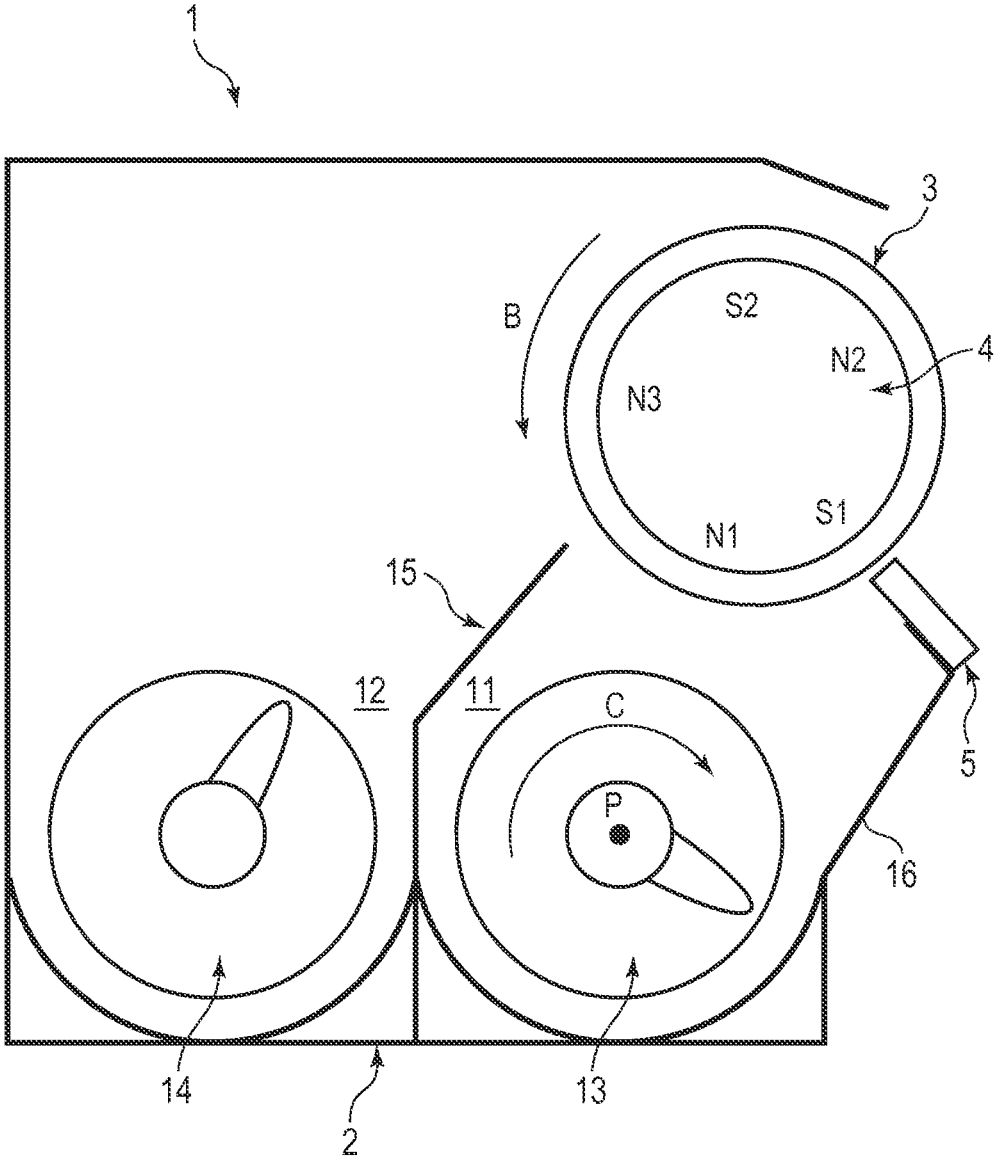
FIG. 7 is a sectional view of a developing device according to a second embodiment.
Figure 8:
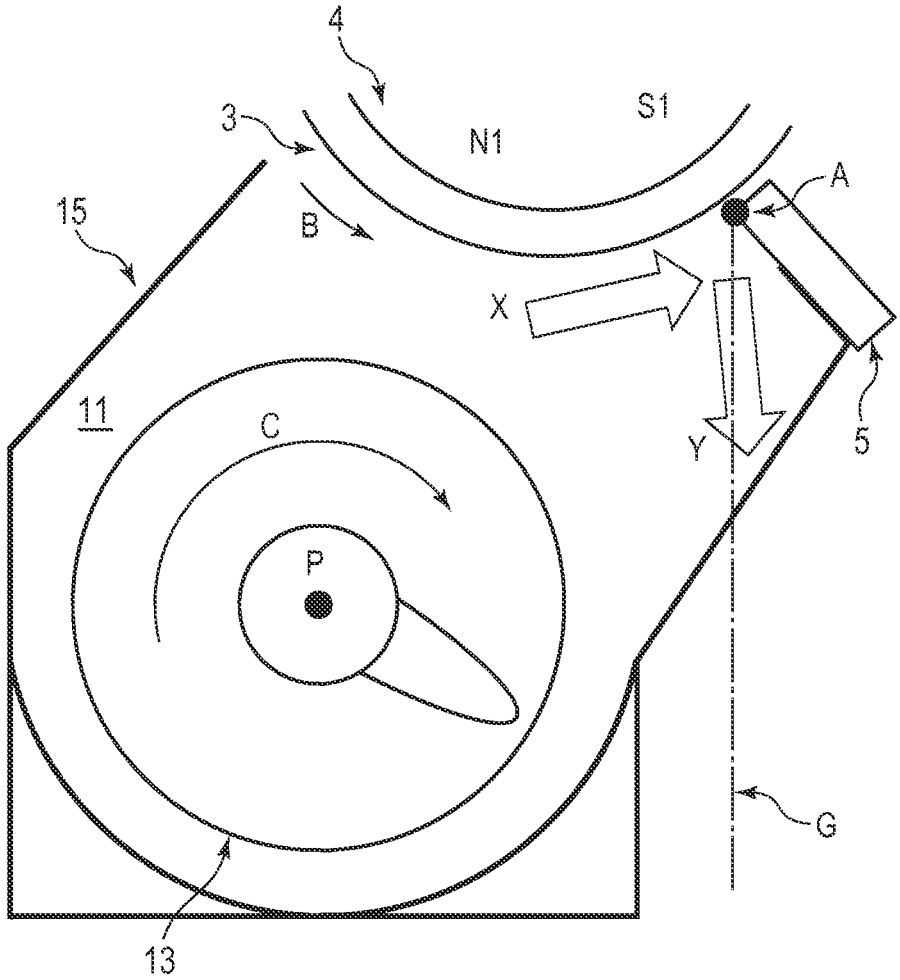
FIG. 8 is a sectional view illustrating features of the developing device in detail according to the second embodiment.

As illustrated in FIGS. 7 and 8, the developing device 1 of the embodiment is different from that of the first embodiment in the arrangement of the developing sleeve 3, the blade 5, and the first screw 13.

In the embodiment, in the same way as in the first embodiment, the same technical effect of the first embodiment can be achieved by causing the developer to flow in a direction indicated by the arrow X and a direction indicated by the arrow Y of FIG. 8. Note that, unlike the first embodiment, the second embodiment does not have the configuration in which "a vertical line G extending downward from a closest point A between the blade 5 and the developing sleeve 3 is arranged between a tangent L drawn from the closest point A to the descending side of the first screw 13 and a rotation-axis center point P of the first screw 13." That is, the first screw 13 is arranged off the vertical line G passing through the closest point A between the blade 5 and the developing sleeve 3 in the second embodiment. The embodiment has instead a configuration in which the developer that has fallen by being regulated with the blade 5 is guided toward the first screw 13 by an inner wall 16 (guide section 16) of the developing chamber 11.

Specifically, an angle formed by a horizontal direction and the inner wall 16 formed between the blade 5 and the first screw 13 with respect to the horizontal direction is larger than a repose angle of the developer. Note that, a close portion between the developing chamber 11 and the first screw 13 is provided with a predetermined clearance so that the developing chamber 11 and the first screw 13 are out of contact with each other, but the inner wall 16 is connected to the clearance portion while keeping the above-mentioned inclination angle.

Figure 9:
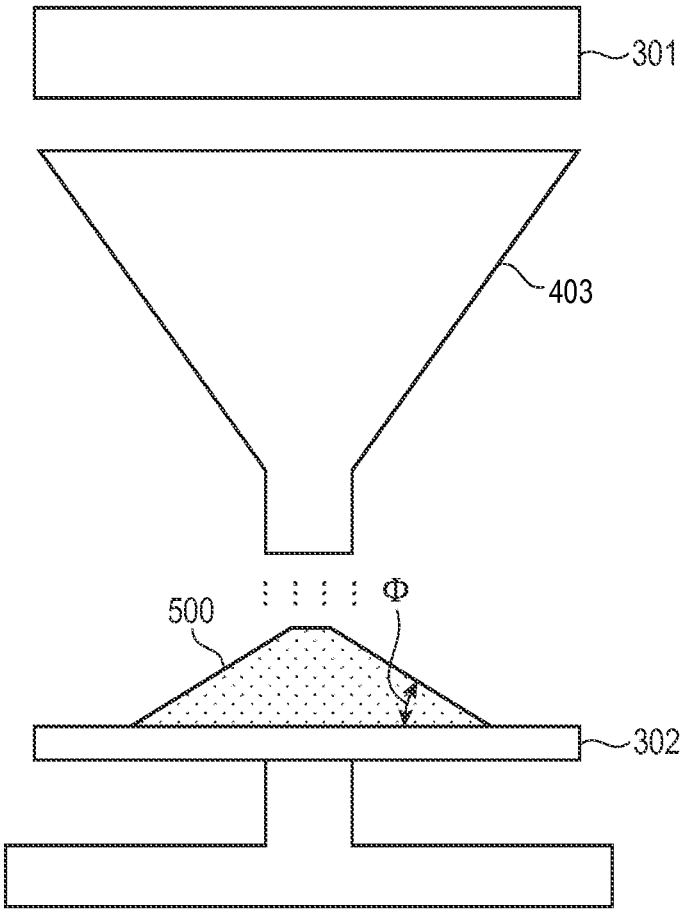
FIG. 9 is a view illustrating a method of measuring a repose angle of developer to be used in the second embodiment.

The repose angle of the developer will be described. FIG. 9 is a schematic explanatory view illustrating an example of a method of measuring a repose angle. A repose angle Φ of developer 500 in the embodiment is measured by the following method. First, a measurement device is Powder Tester PT-N (manufactured by Hosokawa Micron Co., Ltd.). Further, a measurement method is based on the measurement of a repose angle, which is described in an instruction manual attached to Powder Tester PT-N (opening of sieve 301: 710 μm, vibration time: 180 seconds, amplitude: 2 mm or less). The developer is dropped from a funnel 403 to a disc 302, and an angle formed by the surface of the disc 302 and a generatrix of the developer 500 deposited on the disc 302 in a conical shape is determined as a repose angle. Note that, the sample is left to stand overnight in an environment at a temperature of 23° C. and a relative humidity of 50%, and then the repose angle is measured repeatedly five times with the measurement device in the same environment. Then, an arithmetic average of the measurement results is determined as Φ.

The appropriate repose angle of the developer in the embodiment falls within a range of from 25° to 50°, preferably from 30° to 45°. When the repose angle of the developer is smaller than 25°, image defects such as scattering and generation of blank areas during a plurality of times of transfer are liable to occur due to the high flowability. Further, when the repose angle is larger than 50°, the developability is degraded, and the loads on the first screw 13 and the second screw 14 are increased. In the embodiment, developer having a repose angle Φ of 40° is used.

The angle of the inner surface of the developing chamber 11 of the embodiment is larger than the repose angle Φ, and hence the fallen developer falls to a region on a right side of the first screw 13 without being retained on the inner surface. With this configuration, the developer flows smoothly in the direction indicated by the arrow Y. Thus, the friction between the particles of the developer is reduced, and hence the life of the developer can be kept long.

(Third Embodiment)

Now, a developing device according to a third embodiment of the present invention will be described with reference to FIG. 10.

Figure 10:
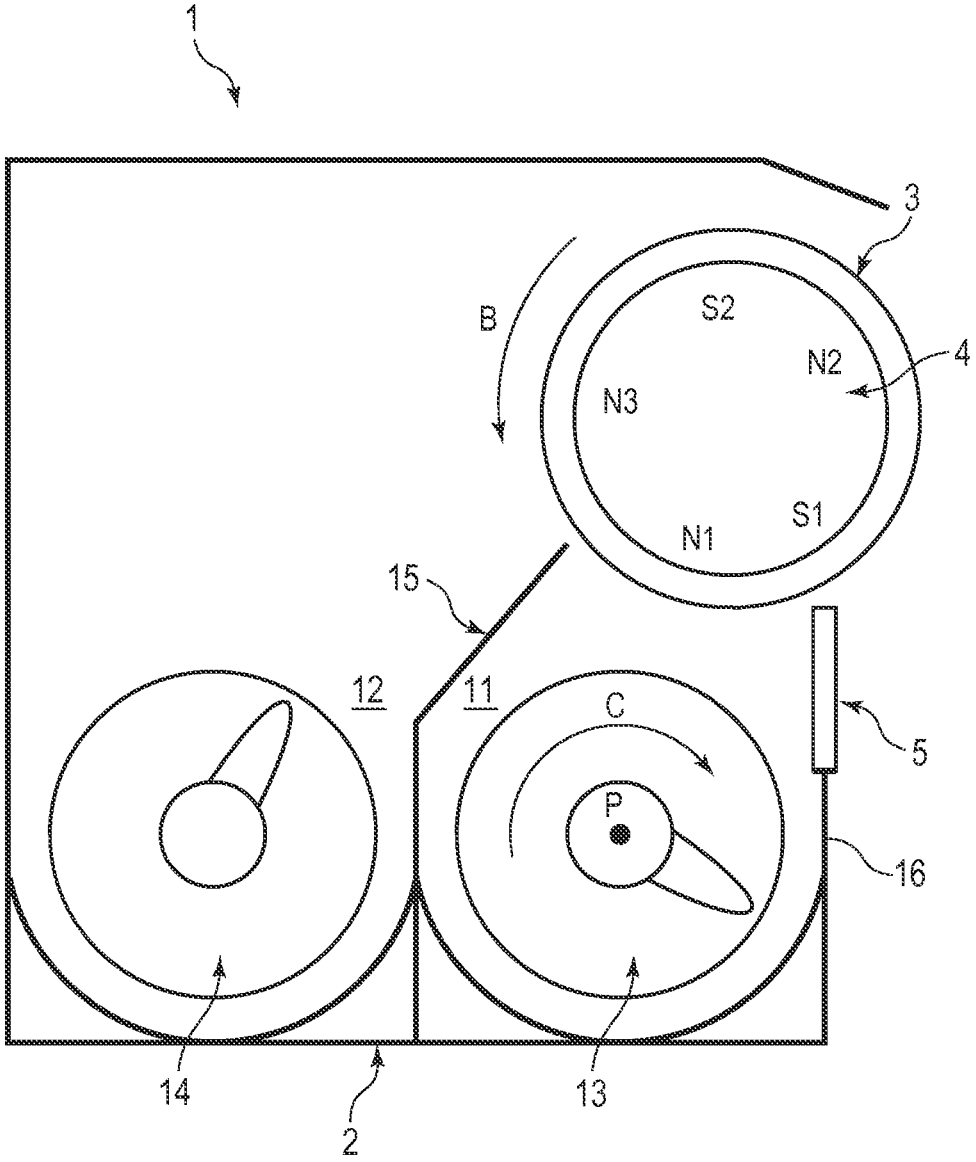
FIG. 10 is a sectional view of a developing device according to a third embodiment.

As illustrated in FIG. 10, in the developing device 1 of the embodiment, the blade 5 is arranged at a predetermined angle with respect to a line connecting the center of the developing sleeve 3 and the distal end portion of the blade 5. According to the spirit of the present invention, it is not necessary that the blade 5 be arranged substantially perpendicularly to the peripheral surface of the developing sleeve 3 as in the first embodiment of FIG. 3 and as in the second embodiment of FIG. 8, and the arrangement of the blade 5 may be determined freely as a matter of design. The blade 5 may be arranged in parallel to the gravity direction. The blade 5 of the embodiment corresponds to the inner wall 16 (FIG. 7) of the developing chamber 11 in the second embodiment. This is an example in which the angle formed by the blade 5 and the horizontal direction is 90°, which is larger than the repose angle Φ.

Note that, the description of the present invention has been directed to the configuration in which the first screw 13 and the second screw 14 are aligned in the horizontal direction, but the present invention is not limited thereto. As illustrated in FIG. 6, the rotation centers of the first screw 13 and the second screw 14 may be arranged in a diagonal relationship, or may be arranged at different heights.

According to the present invention, it is possible to provide the developing apparatus of the separate function type, which is configured to suppress degradation in developer that may be caused by accumulation of the developer at the blade facing portion in a case where the blade configured to regulate the layer thickness of the developer carrying member is provided below the developer carrying member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-250609, filed Dec. 3, 2013, which is hereby incorporated by reference herein in its entirety.

What is claimed is:

1. A developing apparatus, comprising:

a developer carrying member provided in a rotatable manner so as to face an image bearing member on which a latent image is formed, and configured to carry developer including toner and magnetic carrier so as to develop the latent image;

a regulating member configured to regulate the developer carried on the developer carrying member, the regulating member having a distal end portion facing the developer carrying member, with the distal end portion being positioned below a rotation center of the developer carrying member in a gravity direction;

a first chamber configured to supply the developer to the developer carrying member;

a second chamber provided adjacent to the first chamber, and configured to collect the developer directly from the developer carrying member;

a partition wall separating the first chamber and the second chamber, with the developer being circulated between the first chamber and the second chamber through openings formed in both end portions of the partition wall;

a first conveying screw provided in a rotatable manner in the first chamber, the first conveying screw conveying the developer in the first chamber in an axial direction of the developer carrying member; and a second conveying screw provided in a rotatable manner in the second chamber, the second conveying screw conveying the developer in the second chamber in a direction opposite to a direction in which the developer is conveyed by the first conveying screw, wherein the first conveying screw being provided at a position overlapping with a vertical line passing through a portion of the regulating member, with the portion of the regulating member being closest to the developer carrying member, a rotation direction of the first conveying screw being defined so that a periphery of the first conveying screw is moved in the same direction as a peripheral surface of the developer carrying member at a position at which the first conveying screw faces the developer carrying member, and the vertical line overlapping with a part of a rotation region of the first conveying screw in which the periphery of the first conveying screw is moved in a downward direction.

2. A developing apparatus according to claim 1, further comprising a magnet fixed at an inside of the developer carrying member and configured to generate a magnetic field for causing the developer to be carried on the developer carrying member, the magnet comprising a plurality of magnetic poles including a pair of magnetic poles composed of a first magnetic pole and a second magnetic pole, the second magnetic pole having the same polarity as a polarity of the first magnetic pole and being arranged adjacently to the first magnetic pole at a downstream side with respect to the first magnetic pole in the rotation direction of the developer carrying member, wherein a position of the second magnetic pole is arranged on an upstream side in the rotation direction of the developer carrying member with respect to a closest position between the developer carrying member and the first conveying screw.

3. A developing apparatus according to claim 2, wherein the second magnetic pole comprises a scooping magnetic pole configured to scoop the developer from the first chamber to the developer carrying member.

4. A developing apparatus according to claim 2, wherein a distal end portion of the partition wall is extended toward an area between the first magnetic pole and the second magnetic pole in the peripheral surface of the developer carrying member.

5. A developing apparatus according to claim 1, wherein a rotation center of the first conveying screw and a rotation center of the second conveying screw are arranged below the rotation center of the developer carrying member in the gravity direction.

6. A developing apparatus according to claim 1, wherein the first conveying screw and the second conveying screw are provided at positions overlapping with each other as viewed in a horizontal direction.

7. A developing apparatus according to claim 1, wherein the partition wall is provided with a slope portion configured to guide the developer from the developer carrying member to the second chamber.

8. A developing apparatus according to claim 1, wherein a distal end portion of the partition wall is disposed in an area into which the developer carrying member is vertically projected.

* * * * *